US010429757B2

(12) United States Patent
Yoshida et al.

(10) Patent No.: US 10,429,757 B2
(45) Date of Patent: Oct. 1, 2019

(54) TONER

(71) Applicant: CANON KABUSHIKI KAISHA, Tokyo (JP)

(72) Inventors: Sara Yoshida, Mishima (JP); Shinsuke Mochizuki, Yokohama (JP); Tsuneyoshi Tominaga, Suntou-gun (JP); Kenta Kamikura, Yokohama (JP); Tsutomu Shimano, Mishima (JP); Kentaro Yamawaki, Mishima (JP); Akane Masumoto, Suntou-gun (JP); Tomonori Matsunaga, Suntou-gun (JP); Kunihiko Nakamura, Gotemba (JP); Toshihiko Katakura, Kashiwa (JP); Shiro Kuroki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/974,187

(22) Filed: May 8, 2018

(65) Prior Publication Data

US 2018/0329320 A1 Nov. 15, 2018

(30) Foreign Application Priority Data

May 15, 2017 (JP) ..... 2017-096504
May 15, 2017 (JP) ..... 2017-096534
May 15, 2017 (JP) ..... 2017-096544

(51) Int. Cl.
*G03G 9/093* (2006.01)
*G03G 9/097* (2006.01)
(Continued)

(52) U.S. Cl.
CPC ..... *G03G 9/09328* (2013.01); *G03G 9/08* (2013.01); *G03G 9/0819* (2013.01);
(Continued)

(58) Field of Classification Search
CPC . G03G 9/093; G03G 9/09307; G03G 9/09314
See application file for complete search history.

(56) References Cited

U.S. PATENT DOCUMENTS 4,952,476 A 8/1990 Sakashita et al.
4,985,327 A 1/1991 Sakashita et al.
(Continued)

FOREIGN PATENT DOCUMENTS

JP 2009-186640 A 8/2009
JP 5407377 B2 2/2014

OTHER PUBLICATIONS

U.S. Appl. No. 15/969,318, Tsuneyoshi Tominaga, filed May 2, 2018.
(Continued)

*Primary Examiner* — Peter L Vajda
(74) *Attorney, Agent, or Firm* — Venable LLP

(57) ABSTRACT

A toner comprising a toner particle that contains a binder resin and a release agent, wherein the toner particle has a surface layer that contains an organosilicon polymer and the luminance histogram of a backscattered electron image of the toner particle has two peak values P1 and P2 and a minimum value V between P1 and P2, P2 originates from the organosilicon polymer, and the luminance giving P1 and P2 are in specific ranges, percentages for P1 and P2 are each at least 0.50%, and using the luminance Bl at V as a reference point, specific relationships are satisfied by A1, AV, and A2, where A1 is the total number of pixels at luminance from 0 to (Bl−30 ), AV is the total number of pixels at luminance from (Bl−29 ) to (Bl+29 ), and A2 is the total number of pixels at luminance from (Bl+30 ) to 255.

3 Claims, 3 Drawing Sheets

(51) Int. Cl.

| | |
|---|---|
| ***G03G 9/08*** | (2006.01) |
| ***G03G 9/087*** | (2006.01) |
| ***G03G 9/113*** | (2006.01) |
| *G03G 9/083* | (2006.01) |
| *G03G 9/107* | (2006.01) |

(52) U.S. Cl.

CPC ..... *G03G 9/0821* (2013.01); *G03G 9/0825* (2013.01); *G03G 9/08711* (2013.01); *G03G 9/08755* (2013.01); *G03G 9/08773* (2013.01); *G03G 9/09307* (2013.01); *G03G 9/09342* (2013.01); *G03G 9/09364* (2013.01); *G03G 9/09371* (2013.01); *G03G 9/09392* (2013.01); *G03G 9/09708* (2013.01); *G03G 9/09783* (2013.01); *G03G 9/1136* (2013.01); *G03G 9/0833* (2013.01); *G03G 9/107* (2013.01)

(56) References Cited

U.S. PATENT DOCUMENTS

| | | | |
|---|---|---|---|
| 5,014,089 | A | 5/1991 | Sakashita et al. |
| 5,202,213 | A | 4/1993 | Nakahara et al. |
| 5,532,101 | A | 7/1996 | Nozawa et al. |
| 5,534,982 | A | 7/1996 | Sakaizawa et al. |
| 5,731,122 | A | 3/1998 | Yoshida et al. |
| 5,774,771 | A | 6/1998 | Yoshida et al. |
| 5,915,150 | A | 6/1999 | Kukimoto et al. |
| 5,948,584 | A | 9/1999 | Hashimoto et al. |
| 5,998,080 | A | 12/1999 | Ohno et al. |
| 6,214,509 | B1 | 4/2001 | Kasuya et al. |
| 6,300,024 | B1 | 10/2001 | Yusa et al. |
| 6,337,169 | B1 | 1/2002 | Hashimoto et al. |
| 6,696,211 | B2 | 2/2004 | Yoshida et al. |
| 6,806,016 | B2 | 10/2004 | Ohno et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,372,573 | B2 | 2/2013 | Ayaki et al. |
| 8,383,313 | B2 | 2/2013 | Ayaki et al. |
| 8,551,680 | B2 | 10/2013 | Ayaki et al. |
| 8,574,801 | B2 | 11/2013 | Itabashi et al. |
| 8,609,312 | B2 | 12/2013 | Itabashi et al. |
| 8,822,120 | B2 | 9/2014 | Abe et al. |
| 8,828,639 | B2 | 9/2014 | Kamikura et al. |
| 8,986,914 | B2 | 3/2015 | Fujikawa et al. |
| 9,029,056 | B2 | 5/2015 | Kenmoku et al. |
| 9,034,549 | B2 | 5/2015 | Shiotari et al. |
| 9,098,002 | B2 | 8/2015 | Kenmoku et al. |
| 9,098,003 | B2 | 8/2015 | Masumoto et al. |
| 9,158,216 | B2 | 10/2015 | Shimano et al. |
| 9,261,806 | B2 | 2/2016 | Moribe et al. |
| 9,285,697 | B2 | 3/2016 | Fukudome et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,529,289 | B2 * | 12/2016 | Abe ..... G03G 9/0806 |
| 9,575,424 | B2 | 2/2017 | Nakagawa et al. |
| 9,594,323 | B2 | 3/2017 | Fujikawa et al. |
| 9,599,919 | B2 | 3/2017 | Isono et al. |
| 9,658,551 | B2 * | 5/2017 | Terui ..... G03G 9/08708 |
| 9,720,340 | B2 | 8/2017 | Tominaga et al. |
| 9,733,583 | B2 * | 8/2017 | Kuroki ..... G03G 9/0825 |
| 9,733,584 | B2 * | 8/2017 | Masumoto ..... G03G 9/0825 |
| 9,766,566 | B2 * | 9/2017 | Mochizuki ..... G03G 9/09321 |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,864,290 | B2 * | 1/2018 | Yamawaki ..... G03G 9/0904 |
| 9,880,478 | B2 | 1/2018 | Shimano et al. |
| 9,897,932 | B2 | 2/2018 | Hotta et al. |
| 9,897,933 | B2 * | 2/2018 | Yoshida ..... G03G 9/0819 |
| 9,921,501 | B2 | 3/2018 | Mochizuki et al. |
| 9,952,523 | B2 | 4/2018 | Shimano et al. |
| 10,054,866 | B2 * | 8/2018 | Tanaka ..... G03G 9/08755 |
| 2001/0018158 | A1 | 8/2001 | Yoshida et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0065174 | A1 | 3/2013 | Itabashi et al. |
| 2015/0099220 | A1 * | 4/2015 | Abe ..... G03G 9/09328 430/108.3 |
| 2015/0248071 | A1 | 9/2015 | Katsura et al. |
| 2016/0299446 | A1 | 10/2016 | Kuroki et al. |
| 2017/0123333 | A1 | 5/2017 | Kuroki et al. |
| 2017/0299972 | A1 | 10/2017 | Tanaka et al. |

OTHER PUBLICATIONS

U.S. Appl. No. 15/973,661, Kenta Kamikura, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.

* cited by examiner

TONER

BACKGROUND OF THE INVENTION

Field of the Invention

The present invention relates to a toner for developing electrostatic images used in image-forming methods such as electrophotography and electrostatic printing.

Lower energy consumptions and substantially higher image qualities have been required in recent years of laser printers and copiers. In response to these demands, various investigations have been carried out in order to develop toners having an excellent low-temperature fixability and an excellent development transferability.

Within this context, toners have been proposed that, while maintaining low-temperature fixability, avoid wraparound by thin paper on the heating element of the fixing unit. Japanese Patent Application Laid-open No. 2009-186640 discloses an art for suppressing wraparound, in which a core particle is coated with a resin shell layer and a prescribed hole population is formed in the shell layer. However, an external additive is required since, with the presence of only a resin shell layer, there are problems with development transferability in terms of the flowability and charging performance. However, as continuous use proceeds, burying of the external additive or its detachment becomes a problem, and there has still been room for improvement with respect to the durability.

As art for increasing the charge stability and improving the durability, Japanese Patent No. 5,407,377 therefore proposes a toner that has both a coating layer of a silane compound and externally added inorganic particles.

However, with regard to the art described in Japanese Patent No. 5,407,377, the impairment in the fixing performance due to the height of the coverage at the toner base particle is not insignificant, and in particular the problem has remained of wraparound of the fixing unit by thin paper at low temperatures.

An object of the present invention is to provide a toner that exhibits both development transferability after continuous use and low-temperature fixability, and specifically to provide a toner that resists the occurrence of wraparound of the fixing unit by thin paper during low-temperature fixing and that resists the occurrence of transfer drop-out even after durability testing in a high-temperature, high-humidity environment.

The present invention relates to a toner comprising a toner particle that contains a binder resin and a release agent, wherein the toner particle has a surface layer that contains an organosilicon polymer; and, for a luminance histogram, obtained by acquiring a backscattered electron image of a 1.5 μm-by-1.5 μm square of the surface of the toner particle in scanning electron microscopic observation of the toner particle surface, and classifying a luminance of each pixel constituting this backscattered electron image into 256 levels from a luminance of 0 to a luminance of 255, and moreover placing the luminance on an abscissa and the number of pixels on an ordinate in this luminance histogram, (i) two peak values P1 and P2 and a minimum value V between P1 and P2 are present, and the peak containing P2 is a peak originating from the organosilicon polymer, (ii) the luminance giving P1 is from 20 to 70, (iii) the luminance giving P2 is from 130 to 230, (iv) a percentage for P1 and a percentage for P2 with respect to the total number of pixels in the backscattered electron image are each at least 0.50%, and (v) formulas (1) and (2) below are satisfied $$(A1/AV) \geq 1.50 \quad (1)$$

$$(A2/AV) \geq 1.50 \quad (2)$$

where Bl is the luminance giving V, A1 is the total number of pixels in a luminance range from 0 to (Bl−30), AV is the total number of pixels in a luminance range from (Bl−29) to (Bl+29), and A2 is the total number of pixels in a luminance range from (Bl+30) to 255.

The present invention can thus provide a toner that resists the occurrence of wraparound of the fixing unit by thin paper during low-temperature fixing and resists the occurrence of transfer drop-out even after durability testing in a high-temperature, high-humidity environment.

Further features of the present invention will become apparent from the following description of exemplary embodiments with reference to the attached drawings.

DESCRIPTION OF THE EMBODIMENTS

Figure 1A:
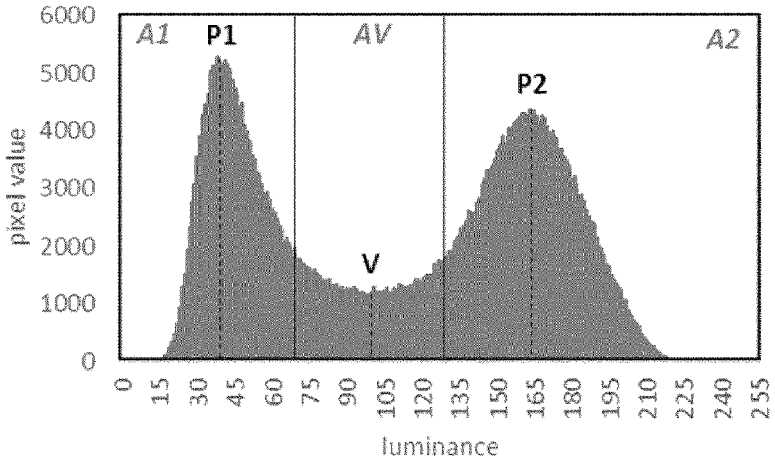
FIGS. 1A to 1C are examples of a luminance histogram acquired from the backscattered electron image of the toner particle surface.

Unless specifically indicated otherwise, the phrases "from XX to YY" and "XX to YY" indicating numerical value ranges refer to numerical value ranges that include the lower limit and upper limit that are provided as the end points.

The present invention is described in detail in the following.

The present invention is a toner comprising a toner particle that contains a binder resin and a release agent, wherein the toner particle has a surface layer that contains an organosilicon polymer; and, for a luminance histogram, obtained by acquiring a backscattered electron image of a 1.5 μm-by-1.5 μm square of the surface of the toner particle in scanning electron microscopic observation of the toner particle surface, and classifying a luminance of each pixel constituting this backscattered electron image into 256 levels from a luminance of 0 to a luminance of 255, and moreover placing the luminance on an abscissa and the number of pixels on an ordinate in this luminance histogram, (i) two peak values P1 and P2 and a minimum value V between P1 and P2 are present, and the peak containing P2 is a peak originating from the organosilicon polymer, (ii) the luminance giving P1 is from 20 to 70, (iii) the luminance giving P2 is from 130 to 230, (iv) a percentage for P1 and a percentage for P2 with respect to the total number of pixels in the backscattered electron image are each at least 0.50%, and (v) formulas (1) and (2) below are satisfied $$(A1/AV) \geq 1.50 \quad (1)$$

$$(A2/AV) \geq 1.50 \quad (2)$$

where Bl is the luminance giving V, A1 is the total number of pixels in a luminance range from 0 to (Bl−30), AV is the total number of pixels in a luminance range from (Bl−29) to (Bl+29), and A2 is the total number of pixels in a luminance range from (Bl+30) to 255.

The acquisition conditions for the backscattered electron image in the present invention, vide infra, are established so as to reflect the outermost surface of the toner particle. With these acquisition conditions, the electron beam penetration region and region of x-ray generation for the individual elements, as estimated from the Kanaya-Okayama equation, is approximately several tens of nanometers. In the present invention, the backscattered electron image for a 1.5 μm-by-1.5 μm square of the toner particle surface is acquired by scanning electron microscopic observation of the surface of the toner particle having an organosilicon polymer-containing surface layer. The luminance of each pixel constituting this backscattered electron image is classified into 256 levels from a luminance of 0 to a luminance of 255, and a luminance histogram is constructed by placing the luminance on the abscissa and the pixel count on the ordinate. When this is done, two peak values P1 and P2 and a minimum value V between P1 and P2 must be present in the resulting luminance histogram.

In this luminance histogram, a low luminance is dark (black) and a high luminance is bright (white). The backscattered electron image obtained using a scanning electron microscope is also referred to as a "compositional image", and elements with smaller atomic numbers are detected as darker and elements with higher atomic numbers are detected as brighter. Because the toner particle has an organosilicon polymer at the surface, the peak containing the value P1 at a lower luminance originates from the base body of the toner particle, and the peak containing the value P2 at the higher luminance originates from the organosilicon polymer.

Figure 1B:
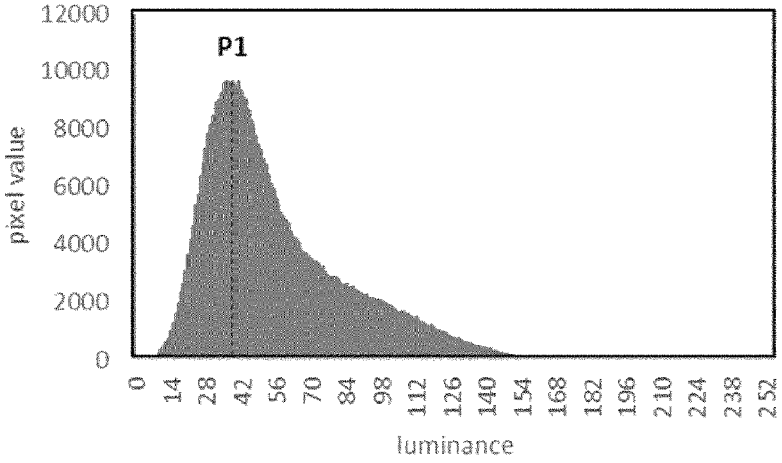

This base body denotes a composition having carbon as its main component, e.g., of the binder resin and release agent present in the toner particle. In addition, that the P2-containing peak derives from the organosilicon polymer can be confirmed by combining the backscattered electron image with the element mapping image provided by energy-dispersive x-ray analysis (EDS), which can be acquired by scanning electron microscopic observation. One requirement of the present invention is that the histogram is bimodal, having P1 derived from the base body of the toner particle, P2 derived from the organosilicon polymer, and a minimum value V between P1 and P2 (for example, FIG. 1A). The requirement of the present invention is not satisfied in the case of a monomodal histogram, as in FIG. 1B, in which the luminance histogram has one peak value (P1 or P2) and does not have the minimum value V.

It is also essential that the luminance giving P1 is from 20 to 70 and that the luminance giving P2 is from 130 to 230. When the luminance at P1 and the luminance at P2 are separated to a certain degree and the luminance at P1 and the luminance at P2 are each within a certain range, there is then little overlap between the peak 1 having the peak value P1 and the peak 2 having the peak value P2 and an excellent separation occurs. The wording "the luminance giving P1" or "the luminance giving P2" means a luminance when the number of pixels is peak value P1 or P2, respectively.

As noted above, the peak containing P1 originates with the base body of the toner particle and the peak containing P2 originates with the organosilicon polymer. When there is good separation between peak 1 and peak 2, the base body of the toner particle and the organosilicon polymer are efficiently localized on the toner particle surface and their respective functionalities, infra, are then more effectively expressed. The luminance giving P1 is preferably from 20 to 60, and the luminance giving P2 is preferably from 140 to 230.

The percentage for P1 and the percentage for P2 with respect to the total number of pixels in the backscattered electron image must each be at least 0.50%.

Moreover, it is an essential requirement that the following formulas (1) and (2) be satisfied $$(A1/AV) \geq 1.50 \quad (1)$$

$$(A2/AV) \geq 1.50 \quad (2)$$

Figure 1C:
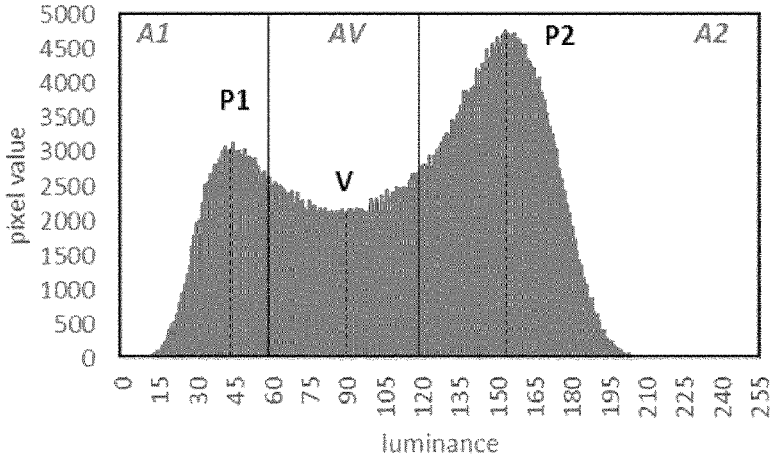

(for example, FIG. 1A) where Bl is the luminance giving the minimum value V, A1 is the total number of pixels in the luminance range from 0 to (Bl−30), AV is the total number of pixels in the luminance range from (Bl−29) to (Bl+29), and A2 is the total number of pixels in the luminance range from (Bl+30) to 255. The requirements of the present invention are not met when the luminance histogram does not satisfy the relationships in formulas (1) and (2), as in FIG. 1C. The peak 1 in which P1 is the peak value is the main component of the pixel count A1 for the luminance range from 0 to (Bl−30), and the peak 2 in which P2 is the peak value is the main component of the pixel count A2 for the luminance range from (Bl+30) to 255. Because, as indicated above, P1 originates with the base body of the toner particle and P2 originates with the organosilicon polymer, each of the pixels contained in A1 is attributed to the base body of the toner particle and each of the pixels contained in A2 is attributed to the organosilicon polymer.

That is, a larger P1 and a higher A1 indicate that the base body component is present at the toner particle surface to a satisfactory degree, and a larger P2 and a higher A2 indicate that the organosilicon polymer component is present at the toner particle surface to a satisfactory degree. This makes it possible to achieve a toner that resists the occurrence of wraparound of the fixing unit by thin paper even during low-temperature fixing and that resists the occurrence of transfer drop-out even after durability testing in a high-temperature, high-humidity environment.

When the base body component of the toner particle is present on the toner particle surface to a satisfactory degree, even in the case of a low fixation temperature, outmigration of the release agent from the base body of the toner particle readily occurs. While it is known that thin paper is prone to engage in wraparound, the outmigration of the release agent in favorable amounts from the base body of the toner particle during fixing facilitates release between thin paper and the members of the fixing unit. When the percentage for P1 with respect to the total number of pixels in the backscattered electron image is at least 0.50% and the following formula (1) is satisfied, $$(A1/AV) \geq 1.50 \quad (1)$$

an inhibitory effect on thin paper wraparound at the fixing unit during low-temperature fixing is then expressed. Considered from the standpoint of the thin paper wraparound behavior during low-temperature fixing, preferred conditions are that the percentage for P1 with respect to the total number of pixels in the backscattered electron image is from 0.70% to 5.00% and the following formula (3) is satisfied.

$$4.00 \geq (A1/AV) \geq 1.70 \quad (3)$$

When, on the other hand, the organosilicon polymer component is present to a satisfactory degree at the toner particle surface, nonelectrostatic adhesion to members such as the photosensitive drum and the intermediate transfer member can be kept low even during transfer in a high-temperature, high-humidity environment. When the nonelectrostatic adhesion is low, the production of transfer drop-out is suppressed due to an increased responsiveness to the transfer voltage.

This transfer drop-out refers to toner that does not transfer at some locations when an image of uniform density is output, and is thus an image defect in which the in-plane uniformity of an image is reduced. The organosilicon polymer can, depending on its polymerization conditions, form an unevenness at the level of several tens to hundreds of nanometers from micro-unevenness at the level of several nanometers, while maintaining at least a certain coverage ratio of the toner particle surface. In addition, while the detailed chemical structure is described below, the organosilicon polymer preferably has a hydrophobic organic group, e.g., a hydrocarbon group, and due to this the surface energy is lowered.

While the mechanism remains uncertain, it is thought that the presence of such an organosilicon polymer at the toner particle surface provides an efficient spacer and both the adhesive force and frequency of contact by the base body of the toner particle with components are then reduced. In addition, the charge stability in high-temperature, high-humidity environments also becomes excellent when, in a preferred embodiment, a hydrophobic organic group, e.g., a hydrocarbon group, is present in the organosilicon polymer. The organosilicon polymer preferably contains the siloxane bond, as a consequence of which it can be present on the toner particle surface as a surface layer having strong covalent bonds and the persistence of the durability then also becomes superior compared to external additives.

When, in the present invention, the percentage for P2 with respect to the total number of pixels in the backscattered electron image is at least 0.50% and the following formula (2) is satisfied, $$(A2/AV) \geq 1.50 \quad (2)$$

an inhibitory effect on transfer drop-out after durability testing in high-temperature, high-humidity environments is then expressed. Preferably the percentage for P2 with respect to the total number of pixels in the backscattered electron image is from 0.70% to 5.00% and the following formula (4) is also satisfied $$4.00 \geq (A2/AV) \geq 1.70 \quad (4)$$

because an additional inhibitory effect on transfer drop-out after durability testing in high-temperature, high-humidity environments then accrues.

The AV in formulas (1) to (4) will now be considered. When, as described above, the luminance histogram of the backscattered electron image is bimodal, the ideal configuration for the present invention is a state in which the two peaks originating with the base body of the toner particle and the organosilicon polymer are independent. In this case, there is almost no overlap between the two peaks and AV, which contains the minimum value V, becomes vanishingly small. However, in actuality a luminance histogram is obtained in which the two peaks are connected and AV has a certain number of pixels. In this case, the individual pixels contained in AV are gray values that incorporate both base body and organosilicon polymer components that have flowed in from A1 and A2.

Specifically, for example, the organosilicon polymer may be present as a thin film at the level of several nanometers on the surface of the base body of the toner particle, and/or low-melting-point and low-molecular-weight components originating with the base body of the toner particle may film onto the surface of the organosilicon polymer. In such cases, the effects respectively exercised by the base body and organosilicon polymer are reduced in comparison to when the base body of the toner particle and the organosilicon polymer are each locally present at high purities.

As AV declines, A1 and A2 increase and the base body of the toner particle and the organosilicon polymer are each efficiently localized. That is, a toner can be achieved that resists the occurrence of wraparound of the fixing unit by thin paper even during low-temperature fixing and that resists the occurrence of transfer drop-out even after durability testing in a high-temperature, high-humidity environment. The luminance and pixel count at P1 and P2, the luminance Bl giving the minimum value V, and the pixel counts for A1, A2, and AV can be controlled using the type of monomer for the organosilicon polymer and the reaction temperature, reaction time, reaction solvent, and pH during formation of the organosilicon polymer.

The organosilicon polymer at the toner particle surface preferably forms a network structure on the toner particle surface with the net opening being particles constituted from pixels in the luminance range from 0 to (Bl−30). That is, the organosilicon polymer preferably forms a network structure on the toner particle surface, and, dividing the total pixels in the backscattered electron image into a pixel group A for the luminance range from 0 to (Bl−30) and a pixel group B for the luminance range from (Bl−29) to 255, preferably a network structure due to the pixel group B is observed with the pixel group A being net openings.

In addition, for the domains formed by pixel group A (the particles constituted from the pixels with a luminance from 0 to (Bl−30) (also referred to below as A1 particles)), preferably the number-average value for the area is from $2.00\times10^3$ nm$^2$ to $1.00\times10^4$ nm$^2$ and the number-average value for the Feret diameter is from 60 nm to 200 nm. More preferably, the number-average value for the area is from $2.00\times10^3$ nm$^2$ to $8.00\times10^3$ nm$^2$ and the number-average value for the Feret diameter is from 60 nm to 150 nm.

Figure 2A:
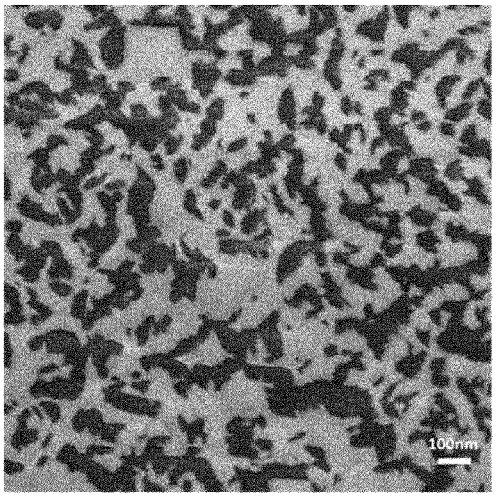
FIGS. 2A, 2A' and 2B are examples of backscattered electron and binarized images of toner particle surfaces showing the presence/absence of a network structure.
Figure 2A:
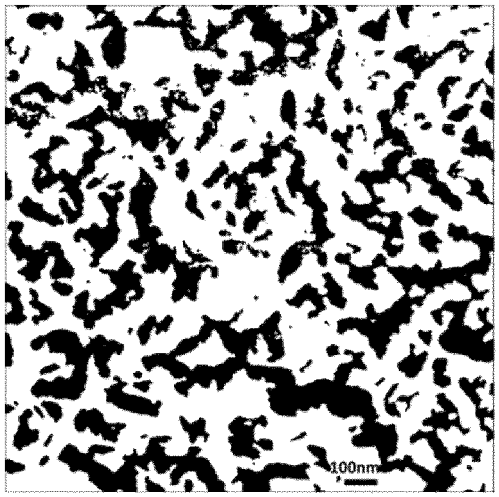

As indicated above, A1 is attributed to the base body of the toner particle. When the organosilicon polymer on the toner particle surface has a network structure, the pixel areas with a luminance from (Bl−29) to 255 (white) form a net, as in FIG. 2A. The domain (A1 particles) areas constituted from pixel areas (black) having a luminance from 0 to (Bl−30), where the organosilicon polymer is not present, form the "openings of the net" in the network structure, and are detected as isolated particles.

While the detailed procedure is described below, the size of the "openings of the net" in the network structure can be expressed by analyzing the particles in the domains (A1 particles) formed by pixel group A and calculating their area and Feret diameter. During fixing, the occurrence of binder resin melting and release agent outmigration is from the A1 particle areas, which are the base body areas of the toner particle.

When the area and Feret diameter of the domains (A1 particles) formed by pixel group A have certain sizes, binder resin melting and release agent outmigration from the base body of the toner particle occur in an advantageous manner during fixing. A toner having an excellent low-temperature fixability can be obtained as a consequence. Here, the Feret diameter is the distance of the longest straight line of the straight lines connecting any two points on the boundary line of the outer periphery of the selection range. When the particle area is at least $2.00\times10^3$ nm$^2$ or the Feret diameter is at least 60 nm, binder resin melting and release agent outmigration then become satisfactory and in particular are advantageous for the low-temperature fixability from the standpoint of blistering.

When, on the other hand, the area of the domains formed by pixel group A is not more than $1.00\times10^4$ $nm^2$ or the Feret diameter is not more than 200 nm, binder resin melting and release agent outmigration become favorable and in particular are advantageous for the low-temperature fixability from the standpoint of the hot offset.

The area and Feret diameter of the domains formed by pixel group A can be controlled using the type of monomer for the organosilicon polymer and the reaction temperature, reaction time, reaction solvent, and pH during formation of the organosilicon polymer.

The following method can be used to confirm that the organosilicon polymer on the toner particle surface forms a network structure in which the net openings are pixel group A. A binarized image in which the pixel areas in the luminance range from 0 to (Bl−30) are made black is obtained from the backscattered electron image, and the formation of a network structure by the organosilicon polymer is confirmed when a configuration as in FIG. 2A' is present.

Figure 2B:
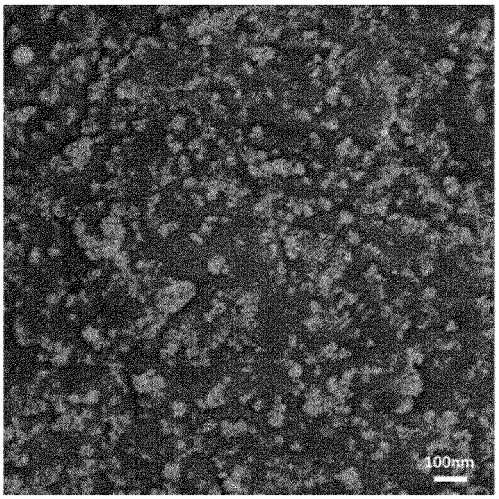

When, on the other hand, the organosilicon polymer on the toner particle surface does not have a network structure, as in FIG. 2B, this is detected as particles in which the pixel areas in the luminance range from (Bl−29) to 255 (white) are isolated. In addition, the A1 particles—which are constituted from pixel areas in the luminance range from 0 to (Bl−30) (black), where the organosilicon polymer is not present—form a net. Thus, when the organosilicon polymer on the toner particle surface does not form the net of a network structure, the area and Feret diameter of the A1 particles assume a trend of enlargement.

The organosilicon polymer in the present invention is preferably a polymer having a structure represented by the following formula (RaT3).

(RaT3)

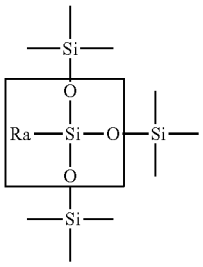

(i)

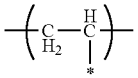

(ii)

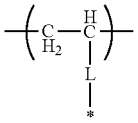

(Ra in the formula represents a hydrocarbon group (preferably an alkyl group) having from 1 to 6 carbons or a vinyl polymer segment containing a substructure represented by the preceding formula (i) or formula (ii). (The * in formulas (i) and (ii) represents a binding segment with the element Si in the RaT3 structure, and the L in formula (ii) represents an alkylene group (preferably the methylene group) or arylene group (preferably the phenylene group).))

Of the four valence electrons on the Si atom in the aforementioned (RaT3) formula, one participates in the bond with Ra and the remaining three participate in the bonds to the oxygen (O) atoms. The O atom has a configuration in which the two valence electrons both participate in bonds with Si, that is, it constitutes the siloxane bond (Si—O—Si). Considered as the Si atoms and O atoms in an organosilicon polymer, three O atoms are present for two Si atoms and this is then expressed as $—SiO_{3/2}$.

When one of these oxygens is made the silanol group, the structure in this organosilicon polymer is then represented by $—SiO_{2/2}—OH$. When two of the oxygens are the silanol group, the structure is then $—SiO_{1/2}(—OH)_2$. The silica structure represented by $SiO_2$ is approached as more of the oxygen atoms form a crosslinked structure with the Si atom. Due to this, the surface free energy of the toner particle surface can be reduced as the $—SiO_{3/2}$ framework becomes more prominent, and as a consequence there is an excellent effect on the environmental stability and resistance to component contamination.

Moreover, since Ra is a hydrophobic organic group, the surface free energy of the toner particle surface is also kept low by the presence of Ra and an excellent effect on the environmental stability is then expressed.

The presence of the siloxane polymer segment ($—SiO_{3/2}$) in the formula (RaT3) can be confirmed by $^{29}$Si-NMR measurement on the tetrahydrofuran-insoluble matter in the toner particle. The presence of Ra in the formula (RaT3) can be confirmed by $^{13}$C-NMR measurement of the tetrahydrofuran-insoluble matter in the toner particle.

This structure can be controlled using the type and amount of the monomer for the organosilicon polymer and the reaction temperature, reaction time, reaction solvent, and pH during formation of the organosilicon polymer.

The sol-gel method is an example of a method for producing the organosilicon polymer. In the sol-gel method, a metal alkoxide $M(OR)_n$ (M: metal, O: oxygen, R: hydrocarbon, n: oxidation number of the metal) is used for the starting material, and hydrolysis and condensation polymerization are carried out in a solvent to induce gelation while passing through a sol state. This method is used for the synthesis of glasses, ceramics, organic-inorganic hybrids, and nanocomposites. The use of this production method supports the production, from the liquid phase at low temperatures, of functional materials having various shapes, e.g., surface layers, fibers, bulk forms, and fine particles. The organosilicon polymer is preferably produced by the hydrolysis and condensation polymerization of a silicon compound as represented by alkoxysilanes (preferably a compound represented by the formula (Z) below).

In addition, the sol-gel method can produce a variety of fine structures and shapes because it starts from a solution and forms a material through gelation of this solution. In particular, when a toner particle is produced in an aqueous medium, the presence on the toner particle surface is readily brought about by the hydrophilicity due to the hydrophilic groups, such as the silanol group, in the organosilicon compound. The aforementioned fine structure and shape can be adjusted through, for example, the reaction temperature, reaction time, reaction solvent, and pH and the type and amount of the silicon compound.

It is known that, in sol-gel reactions, the bond configuration of the siloxane bond produced generally changes as a function of the acidity of the reaction medium. Specifically, when the reaction medium is acidic, the hydrogen ion adds electrophilically to the oxygen in one reactive group (for example, an alkoxy group). The oxygen atom in a water molecule then coordinates with the silicon atom to form a hydroxy group by a substitution reaction. When sufficient water is present, and since one oxygen in a reactive group (for example, an alkoxy group) is attacked by one hydrogen ion, the hydrogen ion content in the medium and the reactive groups become depleted as the reaction progresses, and when this occurs the substitution reaction giving the hydroxy group becomes slow. Accordingly, the polycondensation reaction is produced prior to all of the reactive groups attached to the silane undergoing hydrolysis, and the production of a one-dimensional linear polymer and/or a two-dimensional polymer occurs relatively readily.

When, on the other hand, the medium is alkaline, the hydroxide ion adds to silicon via a pentacoordinate intermediate. Due to this, all of the reactive groups (for example, the alkoxy group) readily undergo elimination and are readily substituted to the silanol group. In particular, when a silicon compound is used that has three or more reactive group on one and the same silane, hydrolysis and polycondensation proceed three dimensionally and an organosilicon polymer containing substantial three-dimensional bonding is formed. The reaction is also finished in a short period of time.

Accordingly, the sol-gel reaction for forming the organosilicon polymer is preferably developed with the reaction medium in an alkaline condition, and specifically the pH is preferably at least 8 in the case of production in an aqueous medium. By doing this, an organosilicon polymer having greater strength and an excellent durability can be obtained.

The organosilicon polymer on the toner particle surface is preferably the condensation polymer of an organosilicon compound having the structure represented by the following formula (Z).

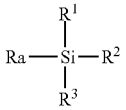

(z)

(In formula (Z), Ra represents a hydrocarbon group. $R^1$, $R^2$, and $R^3$ each independently represent a halogen atom, hydroxy group, acetoxy group, or alkoxy group (preferably having from 1 to 3 carbons).)

Here, Ra is a functional group that becomes the Ra in the RaT3 structure and also encompasses structures represented by the following formula (iii) and formula (iv). Ra is particularly preferably an alkyl group having from 1 to 6 carbons.

$$*\text{—}CH{=}CH_2 \quad \text{(iii)}$$

$$*\text{-}L\text{-}CH{=}CH_2 \quad \text{(iv)}$$

(In formulas (iii) and (iv), * represents a binding segment with the element Si in the structure Z, and the L in formula (iv) represents an alkylene group (preferably the methylene group) or arylene group (preferably the phenylene group).)

The hydrophobicity can be enhanced by the organic group Ra, and a toner particle having an excellent environmental stability can then be obtained. In addition, the phenyl group, which is an aromatic hydrocarbon group, can also be used as the aryl group.

$R^1$, $R^2$, and $R^3$ are each independently a halogen atom, hydroxy group, acetoxy group, or alkoxy group (also referred to in the following as reactive groups). These reactive groups form a crosslinked structure by undergoing hydrolysis, addition polymerization, and condensation polymerization, and a toner can then be obtained that exhibits an excellent resistance to component contamination and an excellent development durability. The alkoxy group is preferred considering its gentle hydrolyzability at room temperature and the ability to precipitate on and coat the toner particle surface, and the methoxy group and ethoxy group are more preferred. The hydrolysis, addition polymerization, and condensation polymerization of $R^1$, $R^2$, and $R^3$ can be controlled through the reaction temperature, reaction time, reaction solvent, and pH.

In order to obtain the organosilicon polymer, a single organosilicon compound having three reactive groups ($R^1$, $R^2$, and $R^3$) in the molecule excluding the Ra in formula (Z) (such an organosilicon compound is also referred to below as a trifunctional silane) may be used, or a combination of a plurality of such organosilicon compounds may be used.

Organosilicon compounds with formula (Z) can be exemplified by the following:

trifunctional vinylsilanes such as vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane; trifunctional allylsilanes such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane; trifunctional methylsilanes such as p-styryltrimethoxysilane, methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional ethylsilanes such as ethyltrimethoxysilane, ethyltriethoxysilane, ethyltrichlorosilane, ethyltriacetoxysilane, and ethyltrihydroxysilane; trifunctional propylsilanes such as propyltrimethoxysilane, propyltriethoxysilane, propyltrichlorosilane, propyltriacetoxysilane, and propyltrihydroxysilane; trifunctional butylsilanes such as butyltrimethoxysilane, butyltriethoxysilane, butyltrichlorosilane, butyltriacetoxysilane, and butyltrihydroxysilane; trifunctional hexylsilanes such as hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane. A single organosilicon compound may be used by itself or a combination of two or more may be used.

The content of the organosilicon compound having the structure represented by formula (Z) in the organosilicon polymer as a result of hydrolysis and polycondensation is preferably at least 50 mol % and is more preferably at least 60 mol %.

An organosilicon compound having four reactive groups in the molecule (tetrafunctional silane), an organosilicon compound having three reactive groups in the molecule (trifunctional silane), an organosilicon compound having two reactive groups in the molecule (difunctional silane), or an organosilicon compound having one reactive group (monofunctional silane) may also be used in addition to the organosilicon compound having the structure represented by formula (Z). The following are examples:

dimethyldiethoxysilane, tetraethoxysilane, hexamethyldisilazane, 3-glycidoxypropyltrimethoxysilane, 3-glycidoxypropylmethyldimethoxysilane, 3-glycidoxypropylmethyldiethoxysilane, 3-glycidoxypropyltriethoxysilane, 2-(3,4-epoxycyclohexyl)ethyltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, N-2-(aminoethyl)-3-aminopropyltrimethoxysilane, N-2-(aminoethyl)-3-aminopropyltriethoxysilane, N-2-(aminoethyl)-3-aminopropylmethyldimethoxysilane, N-phenyl-3-aminopropyltrimethoxysilane, 3-ureidopropyltriethoxysilane, 3-chloropropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, bis(triethoxysilylpropyl) tetrasulfide, trimethylsilyl chloride, triethylsilyl chloride, triisopropylsilyl chloride, t-butyldimethylsilyl chloride, N,N'-bis(trimethylsilyl)urea, N,O-bis(trimethylsilyl)trifluoroacetamide, trimethylsilyl trifluoromethanesulfonate, 1,3-dichloro-1,1,3,3-tetraisopropyldisiloxane, trimethylsilylacetylene, hexamethyldisilane, 3-isocyanatopropyltriethoxysilane, tetraisocyanatosilane, methyltriisocyanatosilane, and vinyltriisocyanatosilane.

The components present in the toner are described in the following.

The toner particle having the organosilicon polymer at the surface contains a binder resin, release agent, and optionally a colorant and other components.

The resins (preferably amorphous resins) generally used as binder resins for toners can be used as the binder resin here. The following, for example, can specifically be used: styrene-acrylic resins (e.g., styrene-acrylate ester copolymers, styrene-methacrylate ester copolymers), polyesters, epoxy resins, and styrene-butadiene copolymers.

The colorant is not particularly limited, and the known colorants indicated in the following can be used.

Yellow pigments can be exemplified by yellow iron oxide and condensed azo compounds, isoindolinone compounds, anthraquinone compounds, azo metal complexes, methine compounds, and allylamide compounds, such as Naples Yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Lake. Specific examples are as follows: C.I. Pigment Yellow 12, 13, 14, 15, 17, 62, 74, 83, 93, 94, 95, 109, 110, 111, 128, 129, 147, 155, 168, and 180.

Orange pigments can be exemplified by the following: Permanent Orange GTR, Pyrazolone Orange, Vulcan Orange, Benzidine Orange G, Indanthrene Brilliant Orange RK, and Indanthrene Brilliant Orange GK.

Red pigments can be exemplified by bengara and condensed azo compounds, diketopyrrolopyrrole compounds, anthraquinone compounds, quinacridone compounds, basic dye lake compounds, naphthol compounds, benzimidazolone compounds, thioindigo compounds, and perylene compounds, such as Permanent Red 4R, Lithol Red, Pyrazolone Red, Watching Red calcium salt, Lake Red C, Lake Red D, Brilliant Carmine 6B, Brilliant Carmine 3B, Eoxin Lake, Rhodamine Lake B, and Alizarin Lake. Specific examples are as follows: C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Blue pigments can be exemplified by copper phthalocyanine compounds and derivatives thereof, anthraquinone compounds, and basic dye lake compounds, such as Alkali Blue Lake, Victoria Blue Lake, Phthalocyanine Blue, metal-free Phthalocyanine Blue, Phthalocyanine Blue partial chloride, Fast Sky Blue, and Indanthrene Blue BG. Specific examples are as follows: C.I. Pigment Blue 1, 7, 15, 15:1, 15:2, 15:3, 15:4, 60, 62, and 66.

Purple pigments are exemplified by Fast Violet B and Methyl Violet Lake.

Green pigments are exemplified by Pigment Green B, Malachite Green Lake, and Final Yellow Green G. White pigments are exemplified by zinc white, titanium oxide, antimony white, and zinc sulfide.

Black pigments are exemplified by carbon black, aniline black, nonmagnetic ferrite, magnetite, and black pigments provided by color mixing using the aforementioned yellow colorants, red colorants, and blue colorants to give a black color. A single one of these colorants may be used by itself, or a mixture of these colorants may be used, and these colorants may be used in a solid solution state.

The content of the colorant is preferably from 3.0 mass parts to 15.0 mass parts per 100 mass parts of the binder resin or polymerizable monomer that produces the binder resin.

There are no particular limitations on the release agent, and known release agent as follows can be used:

petroleum waxes such as paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; fatty acids such as stearic acid and palmitic acid, and compounds thereof; acid amide waxes; ester waxes; ketones; hydrogenated castor oil and derivatives thereof; plant waxes; animal waxes; and silicone resins. The derivatives here include oxides and the block copolymers and graft modifications with vinyl monomers. A single one of these may be used or mixtures of these may be used.

The release agent content is preferably from 5.0 mass parts to 30.0 mass parts per 100 mass parts of the binder resin or polymerizable monomer that produces the binder resin.

The toner particle may contain a charge control agent, and known charge control agents can be used. The amount of addition of these charge control agents is preferably 0.01 to 10.00 mass parts per 100 mass parts of the binder resin or polymerizable monomer that produces the binder resin.

Various organic or inorganic fine powders may be externally added to the toner particle on an optional basis. Considered from the standpoint of the durability when added to the toner particle, the particle diameter of the organic or inorganic fine powder is preferably not more than one-tenth of the weight-average particle diameter of the toner particle.

The following, for example, can be used as the organic fine powders and inorganic fine powders.

(1) Flowability improvers: silica, alumina, titanium oxide, carbon black, and carbon fluoride.

(2) Abrasives: metal oxides (for example, strontium titanate, cerium oxide, alumina, magnesium oxide, and chromium oxide), nitrides (for example, silicon nitride), carbides (for example, silicon carbide), and metal salts (for example, calcium sulfate, barium sulfate, and calcium carbonate).

(3) Lubricants: fluororesin powders (for example, vinylidene fluoride, polytetrafluoroethylene), and metal salts of fatty acids (for example, zinc stearate, calcium stearate).

(4) Charge control particles: metal oxides (for example, tin oxide, titanium oxide, zinc oxide, silica, alumina), and carbon black.

In order to improve the flowability of the toner and provide uniform charging of the toner particle, the surface of the organic or inorganic fine powder may be subjected to a hydrophobic treatment. The treatment agent in the hydrophobic treatment of the organic or inorganic fine powder can be exemplified by unmodified silicone varnishes, various modified silicone varnishes, unmodified silicone oils, various modified silicone oils, silane compounds, silane coupling agents, other organosilicon compounds, and organotitanium compounds. A single one of these treatment agents may be used or a combination may be used.

Specific toner production methods are described in the following, but this does not imply a limitation thereto.

The first production method is a method of obtaining the toner particle by forming a surface layer of the organosilicon polymer in an aqueous medium after a toner base particle has been obtained. This method is preferred because the organosilicon compound is precipitated/polymerized in the neighborhood of the surface of the toner base particle, which as a consequence can efficiently bring about the formation of a layer containing the organosilicon polymer on the toner particle surface.

Thus, a base particle dispersion of the dispersed toner base particle is obtained by producing the binder resin-containing toner base particle and dispersing it in an aqueous medium. The dispersion is preferably carried out to provide a base particle solids fraction of from 10 mass % to 40 mass % with reference to the total amount of the base particle dispersion. The temperature of the base particle dispersion is also preferably adjusted to at least 35° C. on a preliminary basis. In addition, the pH of this base particle dispersion is preferably adjusted to a pH that inhibits the occurrence of organosilicon compound condensation. The pH that inhibits the occurrence of organosilicon compound condensation varies with the particular substance, and as a consequence within ±0.5 centered on the pH at which the reaction is most inhibited is preferred.

The organosilicon compound used has preferably been subjected to a hydrolysis treatment. For example, the organosilicon compound may be hydrolyzed in advance in a separate vessel. The charge concentration for the hydrolysis, using 100 mass parts for the amount of the organosilicon compound, is preferably from 40 mass parts to 500 mass parts of water from which the ion fraction has been removed, e.g., deionized water or RO water, and is more preferably from 100 mass parts to 400 mass parts of water. The hydrolysis conditions are preferably as follows: pH from 1.0 to 7.0, temperature from 15° C. to 80° C., and time of from 1 minute to 600 minutes.

The hydrolyzed organosilicon compound is added to the base particle dispersion. The base particle dispersion and the organosilicon compound hydrolysis solution are stirred and mixed, and holding is preferably carried out at at least 35° C. for from 3 minutes to 120 minutes. An organosilicon polymer-containing surface layer may then be formed on the toner particle surface by adjusting to a pH suitable for condensation (preferably a pH of at least 6.0 or a pH of not more than 3.0, and more preferably a pH of at least 8.0) to bring about condensation of the organosilicon compound all at once and preferably holding at at least 35° C. for at least 60 minutes.

The following are examples of methods for producing the toner base particle.

(1) Suspension polymerization method: the toner base particle is obtained by granulating, in an aqueous medium, a polymerizable monomer composition comprising polymerizable monomer that can produce the binder resin, release agent, optionally colorant and so forth, and polymerizing the polymerizable monomer.

(2) Pulverization method: the toner base particle is obtained by melt-kneading the binder resin, release agent, optionally colorant and so forth, and pulverization.

(3) Dissolution suspension method: an organic phase dispersion—prepared by the dissolution of binder resin, release agent, optionally colorant and so forth in an organic solvent—is suspended, granulated, and polymerized in an aqueous medium, and the organic solvent is then removed to obtain the toner base particle.

(4) Emulsion polymerization and aggregation method: binder resin particles, release agent particles, optionally particles of the colorant and so forth are aggregated in an aqueous medium, and the toner base particle is obtained by coalescence.

In a second production method, the toner particle is obtained by granulating a polymerizable monomer composition—comprising polymerizable monomer that can produce the binder resin, organosilicon compound, release agent, and optionally colorant and so forth—in an aqueous medium and polymerizing the polymerizable monomer.

In a third production method, an organic phase dispersion is produced by dissolving/dispersing a binder resin, organosilicon compound, release agent, and optionally colorant and so forth in an organic solvent; this organic phase dispersion is suspended, granulated, and polymerized in an aqueous medium; and the organic solvent is subsequently removed to obtain the toner particle.

In a fourth production method, binder resin particles, sol- or gel-state particles containing an organosilicon compound, and optionally colorant particles are aggregated and coalesced in an aqueous medium to form the toner particle.

In a fifth production method, a solution containing the organosilicon compound is sprayed onto the toner base particle surface by a spray-drying method and polymerization or drying of the surface is brought about with a hot air current and cooling to form a surface layer containing the organosilicon compound.

The following are examples of the aqueous medium: water, and mixed media of water and an alcohol such as methanol, ethanol, or propanol.

Among the preceding production methods, the most preferred toner particle production method is the method of producing the toner base particle by the suspension polymerization method listed for the first production method. The organosilicon polymer is readily uniformly precipitated on the toner particle surface in the suspension polymerization method, and an excellent environmental stability, an excellent development transferability, and an excellent persistence of their durability are then obtained. The suspension polymerization method is explained in further detail below.

Additional resins may be added on an optional basis to the polymerizable monomer composition. After the completion of the polymerization step, the produced particles are washed, recovered by filtration, and dried to obtain the toner base particle. The temperature may be raised in the second half of the polymerization step. Moreover, in order to remove unreacted polymerizable monomer or by-products, a portion of the dispersion medium may also be distilled from the reaction system either in the second half of the polymerization step or after the polymerization step. The organosilicon polymer-containing surface layer may be formed using the base particle dispersion in which the toner base particles are dispersed, without carrying out washing, filtration, and drying after the completion of the polymerization step.

The following resins can be used as the additional resin within a range that does not influence the effects of the present invention:

homopolymers of styrene and its substituted forms, such as polystyrene and polyvinyltoluene; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosin, modified rosin, terpene resins, phenolic resins, aliphatic and alicyclic hydrocarbon resins, and aromatic petroleum resins. A single one of these may be used by itself or a mixture may be used.

The following polymerizable vinyl monomers are advantageous examples of the polymerizable monomer in the aforementioned suspension polymerization method: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; esters of methylene aliphatic monocarboxylic acids; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

Styrene, styrene derivatives, acrylic polymerizable monomers, and methacrylic polymerizable monomers are preferred among the preceding monomers.

A polymerization initiator may be added to the polymerization of the polymerizable monomer. The polymerization initiator can be exemplified by the following: azo and diazo polymerization initiators such as 2,2'-azobis(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. These polymerization initiators are preferably added at 0.5 to 30.0 mass parts per 100 mass parts of the polymerizable monomer, and a single polymerization initiator may be used or a plurality may be used in combination.

A chain transfer agent may be added to the polymerization of the polymerizable monomer in order to control the molecular weight of the binder resin constituting the toner particle. The preferred amount of addition is 0.001 to 15.000 mass parts per 100 mass parts of the polymerizable monomer.

A crosslinking agent may be added to the polymerization of the polymerizable monomer in order to control the molecular weight of the binder resin constituting the toner particle. Crosslinking monomers can be exemplified by the following: divinyl benzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester-type diacrylates (MANDA, Nippon Kayaku Co., Ltd.), and crosslinking agents provided by converting the acrylates given above to the methacrylates.

The following are examples of polyfunctional crosslinking monomers: pentaerythritol triacrylate, trimethylolethane triacrylate, trimethylolpropane triacrylate, tetramethylolmethane tetraacrylate, oligoester acrylate and the methacrylate thereof, 2,2-bis(4-methacryloxy.polyethoxyphenyl)propane, diacryl phthalate, triallyl cyanurate, triallyl isocyanurate, triallyl trimellitate, and diaryl chlorendate. The preferred amount of addition is 0.001 to 15.000 mass parts per 100 mass parts of the polymerizable monomer.

The following can be used as a dispersion stabilizer of the polymerizable monomer composition particles when the medium used in the suspension polymerization is an aqueous medium: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Organic dispersing agents can be exemplified by polyvinyl alcohol, gelatin, methyl cellulose, methylhydroxypropyl cellulose, ethyl cellulose, the sodium salt of carboxymethyl cellulose, and starch.

A commercial nonionic, anionic, or cationic surfactant may also be used. Such surfactants can be exemplified by sodium dodecyl sulfate, sodium tetradecyl sulfate, sodium pentadecyl sulfate, sodium octyl sulfate, sodium oleate, sodium laurate, and potassium stearate.

The various measurement methods associated with the present invention are described in the following.

When an organic fine powder or inorganic fine powder has been externally added to the toner, the organic fine powder or inorganic fine powder is removed using, for example, the following method, to provide the sample.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume). 1.0 g of the toner is added to this, and clumps of the toner are broken up using, for example, a spatula. The centrifugal separation tube is shaken with a shaker (AS-1N, marketed by AS ONE Corporation) for 20 minutes at 300 strokes per minute (spm). After shaking, the solution is transferred over to a glass tube (50 mL) for swing rotor service, and separation is performed in a centrifugal separator (H-9R, Kokusan Co., Ltd.) using conditions of 3,500 rpm and 30 minutes.

The toner particle is separated from the external additive by this process. Satisfactory separation of the toner from the aqueous solution is checked visually, and the toner separated into the uppermost layer is recovered with, for example, a spatula. The recovered toner is filtered on a vacuum filter and then dried for at least 1 hour in a drier to yield the measurement sample. This process is carried out a plurality of times to secure the required amount.

Method for Acquiring the Backscattered Electron Image of the Toner Particle Surface The backscattered electron image of the toner particle surface was acquired using a scanning electron microscope (SEM).

The SEM instrument and the observation conditions are as follows.

Instrument used: ULTRA PLUS, Carl Zeiss Microscopy GmbH
Acceleration voltage: 1.0 kV
WD: 2.0 mm
Aperture size: 30.0 μm
Detection signal: EsB (energy selective backscattered electron)
EsB Grid: 800 V
Observation magnification: 50,000×
Contrast: 63.0±5.0% (reference value)
Brightness: 38.0±5.0% (reference value)
Resolution: 1,024×768
Pretreatment: the toner particles are sprinkled onto carbon tape (vapor deposition is not performed)

The contrast and brightness are determined according to the following procedure. First, the contrast is set so the two peak values P1 and P2 on the luminance histogram each have the largest possible pixel count and the luminances of P1 and P2 are separated as much as possible. The brightness is then set so the tails of the two peaks having the P1 and P2 values fit into the luminance histogram. This contrast and brightness are suitably set using this procedure in conformity with the configuration of the instrument used. In addition, the acceleration voltage and EsB Grid for the present invention are set to achieve the following items: acquisition of structural data on the outermost surface of the toner particle, inhibition of charge up of the non-vapor-deposited sample, and selective detection of high-energy backscattered electrons. The vicinity around the apex having the smallest toner particle curvature is selected for the field of observation.

Method for Confirming that P2 Originates from the Organosilicon Polymer

That P2 originated from the organosilicon polymer was confirmed by superimposing the aforementioned backscattered electron image with the element mapping image provided by the energy-dispersive x-ray analysis (EDS) that can be acquired with a scanning electron microscope (SEM).

The SEM/EDS instruments and observation conditions are as follows.

Instrument used (SEM): ULTRA PLUS, Carl Zeiss Microscopy GmbH
Instrument used (EDS): NORAN System 7, Ultra Dry EDS Detector, Thermo Fisher Scientific Inc.
Acceleration voltage: 5.0 kV
WD: 7.0 mm
Aperture size: 30.0 μm
Detection signal: SE2 (secondary electron)
Observation magnification: 50,000×
Mode: spectral imaging
Pretreatment: the toner particles are sprinkled on carbon tape, platinum sputtering The silicon element mapping image acquired by this procedure is superimposed on the aforementioned backscattered electron image, and whether the silicon atom areas of the mapping image coincide with the bright areas of the backscattered electron image is checked.

Method for Acquiring the Luminance Histogram

The luminance histogram is acquired by analysis, using ImageJ image processing software (developer: Wayne Rasband), of the backscattered electron image of the toner particle surface yielded by the aforementioned method. The procedure is given in the following.

First, the backscattered electron image of the analysis target is converted to 8-bit with Type in the Image menu. Next, from Filters in the Process menu, the Median diameter is set to 2.0 pixels to reduce the image noise. After excluding the observation conditions display area displayed at the bottom of the backscattered electron image, the image center is estimated and a 1.5 μm-square range is selected from the image center of the backscattered electron image using the Rectangle Tool in the tool bar.

Next, Histogram is selected in the Analyze menu and a luminance histogram is displayed in a new window. The numerical values for the luminance histogram are acquired with List in this window. Fitting of the luminance histogram is performed as necessary. The following are calculated from this: the luminance and number of pixels giving the peak values P1 and P2, the luminance Bl giving the minimum value V, and the number of pixel counts A1, A2, and AV.

This procedure is carried out on 10 fields of observation per toner particle to be evaluated, and the respective average values are used as the property values of the toner particle that are acquired from the luminance histogram.

Method for Analyzing (Calculation of Area and Feret Diameter) the Domains Formed by Pixel Group A The analysis of the domains (A1 particles) formed by pixel group A is carried out using ImageJ image processing software (developer: Wayne Rasband) on the backscattered electron image of the toner particle surface yielded by the aforementioned method. The procedure is given in the following.

First, the backscattered electron image is converted to 8-bit with Type in the Image menu. Next, from Filters in the Process menu, the Median diameter is set to 2.0 pixels to reduce the image noise. After excluding the observation conditions display area displayed at the bottom of the backscattered electron image, the image center is estimated and a 1.5 μm-square range is selected from the image center of the backscattered electron image using the Rectangle Tool in the tool bar.

Threshold is then selected from Adjust in the Image menu. In a manual operation, the total pixels corresponding to the luminance range from 0 to (Bl−30) is selected and the binarized image is obtained by clicking Apply. This operation causes the pixels corresponding to A1 to be displayed in black. After again excluding the observation conditions display area displayed at the bottom of the backscattered electron image, the image center is again estimated and a 1.5 μm-square range is selected from the image center of the backscattered electron image using the Rectangle Tool in the tool bar.

Next, using the Straight Line tool in the tool bar, the scale bar in the observation conditions display area displayed at the bottom of the backscattered electron image is selected. At this point, when Set Scale in the Analyze menu is selected, a new window opens and the pixel distance of the selected straight line is entered in the Distance in Pixels field. A scale bar value (for example, 100) is entered in the Known Distance field of this window; a scale bar unit (for example, nm) is entered in the Unit of Measurement field; and scale setting is completed by clicking OK. Set Measurements in the Analyze menu is then selected and a check is entered for Area and for Feret's Diameter. Analyze Particles in the Analyze menu is selected and a check is entered for Display Result and the particle analysis is performed when OK is clicked. From the newly opened Results window, the particle area (Area) and particle Feret diameter (Feret) are acquired for each particle corresponding to domains (A1 particles) formed by pixel group A and the number-average values are calculated.

This procedure is carried out on 10 fields of observation per toner particle to be evaluated, and the respective arithmetic average values are used.

Method for Confirming a Network Structure for the Organosilicon Polymer

The following method is used to confirm whether the organosilicon polymer on the toner particle surface has formed a network structure on the toner particle surface in which the openings in the net are particles constituted of pixels in the luminance range from 0 to (Bl−30) (a network structure formed by pixel group B, in which the openings in the net are pixel group A).

Proceeding as in the particle analysis procedure for the domains (A1 particles) formed by pixel group A, a 1.5-μm square binarized image is obtained in which the pixel areas in the luminance range from 0 to (Bl−30) have been rendered in black. If this has a presentation as in FIG. 2A', it is then scored as the organosilicon polymer having formed a network structure.

Method for Measuring the Weight-Average Particle Diameter (D4) of the Toner Particle Using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.), to set the measurement conditions and analyze the measurement data, the weight-average particle diameter (D4) of the toner particle was determined by performing the measurements in 25,000 channels for the number of effective measurement channels and analyzing the measurement data.

The aqueous electrolyte solution used for the measurements is prepared by dissolving special-grade sodium chloride in deionized water to provide a concentration of approximately 1 mass %, and, for example, "ISOTON II" (Beckman Coulter, Inc.) can be used.

The dedicated software is configured as follows prior to measurement and analysis. In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1,600 μA; the gain is set to 2; the electrolyte is set to ISOTON II; and a check is entered for the post-measurement aperture tube flush. In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W that is equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner particle-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for Confirming the Structure Represented by the Formula (RaT3)

Confirmation of the structure represented by the formula (RaT3) in the organosilicon polymer is performed using a nuclear magnetic resonance instrument (NMR).

The sample for NMR measurement is prepared as follows.

Measurement sample preparation: 10.0 g of the toner particle is weighed out and is introduced into an extraction thimble (No. 86R, Toyo Roshi Kaisha, Ltd.), and this is placed in a Soxhlet extractor. Extraction is performed for 20 hours using 200 mL of tetrahydrofuran as the solvent, and the residue in the extraction thimble is vacuum dried for several hours at 40° C. to provide the sample for NMR measurement.

The silicon atom-bonded Ra in the structure represented by the formula (RaT3) is confirmed by $^{13}$C-NMR (solid state) measurement. The measurement conditions are given below.

"Measurement Conditions in $^{13}$C-NMR (Solid State)"
Instrument: JNM-ECX500II, JEOL Resonance Inc.
Sample tube: 3.2 mmØ
Sample: tetrahydrofuran-insoluble matter of the toner particle for NMR measurement, 150 mg
Measurement temperature: room temperature
Pulse mode: CP/MAS
Measurement nucleus frequency: 123.25 MHz ($^{13}$C)
Reference substance: adamantane (external reference: 29.5 ppm)
Sample spinning rate: 20 kHz
Contact time: 2 ms
Delay time: 2 s
Number of accumulations: 1,024

When Ra in formula (RaT3) is a structure represented by a hydrocarbon group having from 1 to 6 carbons, the presence of Ra is checked through the presence/absence of a signal originating with, for example, a silicon atom-bonded methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6H_{13}$), or phenyl group (Si—$C_6H_5$).

When Ra in formula (RaT3) is a structure represented by formula (i), the presence of the structure represented by formula (i) is checked through the presence/absence of a signal originating with the silicon atom-bonded methine group (>CH—Si).

When Ra is a structure represented by formula (ii), the presence of the structure represented by formula (ii) is checked through the presence/absence of a signal originating with, for example, a silicon atom-bonded arylene group (for example, the phenylene group (Si—$C_6H_4$—)) or alkylene group, for example, the methylene group (Si—$CH_2$—) or ethylene group (Si—$C_2H_4$—).

The siloxane bond segment in the structure represented by the formula (RaT3) was confirmed by measurement by $^{29}$Si-NMR (solid state). The measurement conditions are given in the following.

"Measurement Conditions in $^{29}$Si-NMR (Solid State)"
Instrument: JNM-ECX500II, JEOL Resonance Inc.
Sample tube: 3.2 mmØ
Sample: tetrahydrofuran-insoluble matter of the toner particle for NMR measurement, 150 mg
Measurement temperature: room temperature
Pulse mode: CP/MAS
Measurement nucleus frequency: 97.38 MHz ($^{29}$Si)
Reference substance: DSS (external reference: 1.534 ppm)
Sample spinning rate: 10 kHz
Contact time: 10 ms
Delay time: 2 s
Number of accumulations: 2,000 to 8,000

After this measurement, peak separation is performed into the following structure X1, structure X2, structure X3, and structure X4 by curve fitting for a plurality of silane components having different substituents and bonding groups, for the tetrahydrofuran-insoluble matter of the toner particle, and their respective peak areas are calculated.

Structure X1 represented by formula (5): $(Ri)(Rj)(Rk)SiO_{1/2}$
Structure X2 represented by formula (6): $(Rg)(Rh)Si(O_{1/2})_2$
Structure X3 represented by formula (7): $RmSi(O_{1/2})_3$
Structure X4 represented by formula (8): $Si(O_{1/2})_4$ (5)

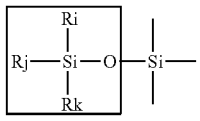

(6)

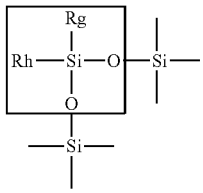

(7)

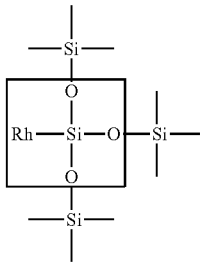

-continued (8)

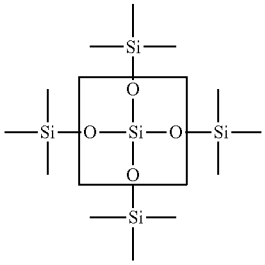

(The Ri, Rj, Rk, Rg, Rh, and Rm in formulas (5) to (8) represent silicon atom-bonded organic groups, e.g., hydrocarbon groups having from 1 to 6 carbons, a halogen atom, hydroxy group, acetoxy group, or alkoxy group.)

The structures in the regions enclosed by the squares in formulas (5) to (8) are structure X1 to structure X4, respectively.

In the chart provided by $^{29}$Si-NMR measurement of the tetrahydrofuran-insoluble matter of the toner, the percentage for the peak area assigned to the formula (RaT3) structure with reference to the total peak area of the organosilicon polymer is preferably from 20% to 100% and is more preferably from 40% to 80%.

When the structure represented by formula (RaT3) must be more finely determined, identification may be carried out using the results from the aforementioned $^{13}$C-NMR and $^{29}$Si-NMR measurements along with the results from $^{1}$H-NMR measurement.

EXAMPLES

The present invention is described in additional detail in the following using specific production examples, examples, and comparative examples, but the present invention is in no way limited thereto or thereby. Unless specifically indicated otherwise, "parts" in the following formulations is on a mass basis.

Toner 1 Production Example

Aqueous Medium 1 Preparation Step 14.0 parts of sodium phosphate (dodecahydrate, RASA Industries, Ltd.) was introduced into 1,000.0 parts of deionized water in a reaction vessel, and the temperature was maintained for 1.0 hour at 65° C. while purging with nitrogen. While stirring at 12,000 rpm using a T. K. Homomixer (Tokushu Kika Kogyo Co., Ltd.), an aqueous calcium chloride solution of 9.2 parts of calcium chloride (dihydrate) dissolved in 10.0 parts of deionized water was added all at once to prepare an aqueous medium containing a dispersion stabilizer. 10 mass % hydrochloric acid was introduced into the aqueous medium to adjust the pH to 6.0, thereby yielding aqueous medium 1.

Polymerizable Monomer Composition Preparation Step

Styrene: 60.0 parts

C.I. Pigment Blue 15:3: 6.5 parts

These materials were introduced into an attritor (Mitsui Miike Chemical Engineering Machinery Co., Ltd.), and a pigment dispersion was prepared by dispersing for 5.0 hours at 220 rpm using zirconia particles having a diameter of 1.7 mm. The following materials were added to this pigment dispersion.

Styrene: 14.0 parts

N-butyl acrylate: 26.0 parts

Crosslinking agent (divinylbenzene): 0.2 parts

Saturated polyester resin: 6.0 parts (polycondensate (molar ratio=10:12) of propylene oxide-modified bisphenol A (2 mol adduct) and terephthalic acid, glass transition temperature Tg=68° C., weight-average molecular weight Mw=10,000, molecular weight distribution Mw/Mn=5.12)

Fischer-Tropsch wax (melting point=78° C.): 10.0 parts

Charge control agent: 0.5 parts (aluminum compound of 3,5-di-tert-butylsalicylic acid)

These were held at 65° C. and dissolution and dispersion to homogeneity were carried out at 500 rpm using a T. K. Homomixer (Tokushu Kika Kogyo Co., Ltd.) to prepare a polymerizable monomer composition.

Organosilicon Compound Aqueous Solution Preparation Step 60.0 parts of deionized water was metered into a reaction vessel equipped with a stirrer and thermometer and the pH was adjusted to 1.5 using 10 mass % hydrochloric acid. The temperature of this was brought to 60° C. by heating while stirring. This was followed by the addition of 40.0 parts of methyltriethoxysilane and stirring for 2 minutes to obtain an organosilicon compound aqueous solution 1.

Granulation Step

While holding the temperature of the aqueous medium 1 at 70° C. and holding the rotation rate of the stirrer at 12,000 rpm, the polymerizable monomer composition was introduced into the aqueous medium 1 and 9.0 parts of the polymerization initiator t-butyl peroxypivalate was added. This was granulated in this state for 10 minutes while maintaining the stirring device at 12,000 rpm.

Polymerization Step

The stirrer was changed over from the high-speed stirrer to a propeller stirring blade, and a polymerization was run for 5.0 hours while maintaining 70° C. while stirring at 150 rpm. A polymerization reaction was then run by raising the temperature to 95° C. and heating for 2.0 hours, to obtain a toner particle slurry. After this, the temperature of the slurry was cooled to 60° C., and measurement of the pH gave pH=5.0. While continuing to stir at 60° C., 20.0 parts of the organosilicon compound aqueous solution 1 was added. After this condition had been maintained for 30 minutes, the slurry was adjusted to pH=9.0 using an aqueous sodium hydroxide solution, and holding for an additional 300 minutes was carried out to form an organosilicon polymer on the toner particle surface.

Washing and Drying Step

After the completion of the polymerization step, the toner particle slurry was cooled; hydrochloric acid was added to the toner particle slurry to adjust the pH to 1.5 or less; holding was carried out for 1 hour while stirring; and solid-liquid separation was subsequently performed using a pressure filter to obtain a toner cake. This was reslurried with deionized water to provide another dispersion, after which solid-liquid separation was performed with the aforementioned filter. Reslurrying and solid-liquid separation were repeated until the electrical conductivity of the filtrate reached 5.0 μS/cm or less, and a toner cake was obtained by the final solid-liquid separation.

The obtained toner cake was dried using a Flash Jet Dryer air current dryer (Seishin Enterprise Co., Ltd.), and the fines and coarse powder were cut using a Coanda effect-based multi-grade classifier to obtain a toner particle 1.

The drying conditions were an injection temperature of 90° C. and a dryer outlet temperature of 40° C., and the toner cake feed rate was adjusted in conformity to the moisture content of the toner cake to a rate at which the outlet temperature did not deviate from 40° C. The obtained toner particle 1 was directly used in this example, without external addition, as toner 1. It was confirmed by the methods indicated above that toner 1 had, on the toner particle surface, a surface layer that contained an organosilicon polymer. The properties of the obtained toner are given in Table 2.

Toners 2 to 19 and Comparative Toners 1, 2, 5, and 6 Production Example

Toners 2 to 19 and comparative toners 1, 2, 5, and 6 were obtained proceeding as in the Toner 1 Production Example, but in accordance with the formulations and production conditions shown in Table 1. The properties of the obtained toners are given in Table 2.

Comparative Toner 3 Production Example 12.0 parts of methyltriethoxysilane was added as such as monomer to the pigment dispersion in the Polymerizable Monomer Composition Preparation Step in the Toner 1 Production Example. The Organosilicon Compound Aqueous Solution Preparation Step was not performed. In the Polymerization Step, the addition of the hydrolysis solution was not carried out and only the pH adjustment and subsequent holding were performed. Comparative toner 3 was otherwise prepared by the same method as in the Toner 1 Production Example. The properties of the obtained toner are given in Table 2.

Comparative Toner 4 Production Example

Comparative toner 4 was obtained proceeding as in the Comparative Toner 3 Production Example, but changing the number of parts of methyltriethoxysilane in the Comparative Toner 3 Production Example to 7.4 parts. The properties of the obtained toner are given in Table 2.

Comparative Toner 7 Production Example

The Organosilicon Compound Aqueous Solution Preparation Step of the Toner 1 Production Example was not performed. After the toner particle slurry had been obtained in the Polymerization Step, the temperature of the slurry was cooled to 60° C. and, while continuing to stir under the same conditions, 8.0 parts of methyltriethoxysilane was added as such as monomer. After holding in this condition for 30 minutes, the slurry was adjusted to pH=9.0 using an aqueous sodium hydroxide solution, and holding was performed for an additional 300 minutes to form an organosilicon polymer on the toner particle surface. Comparative toner 7 was otherwise produced by the same method as in the Toner 1 Production Example. The properties of the obtained toner are given in Table 2.

Comparative Toner 8 Production Example

Comparative toner 8 was obtained proceeding as in the Comparative Toner 7 Production Example, but changing the number of parts of the methyltriethoxysilane in the Comparative Toner 7 Production Example to 9.4 parts. The properties of the obtained toner are given in Table 2.

Comparative Toner 9 Production Example

The Organosilicon Compound Aqueous Solution Preparation Step of the Toner 1 Production Example was not performed. After the toner particle slurry had been obtained in the Polymerization Step, the temperature of the slurry was cooled to 25° C. and, while continuing to stir under the same conditions, 250 parts of methyltriethoxysilane was added as such as monomer. 4,000.0 parts of deionized water was also added. After holding this solution as such for 30 minutes, this solution added dropwise into 10,000.0 parts of an aqueous sodium hydroxide solution adjusted to pH=9.0, and holding was carried out for 48 hours at 25° C. to form an organosilicon polymer on the toner particle surface. Comparative toner 9 was otherwise produced by the same method as in the Toner 1 Production Example. The properties of the obtained toner are given in Table 2.

Image Output Evaluations

Evaluation of the Wraparound Behavior During Low-Temperature Fixation

The fixing unit of an LBP9600C laser beam printer from Canon Inc. was modified to enable adjustment of the fixation temperature. Using the LBP9600C after this modification, the fixation temperature in a normal-temperature, normal-humidity environment (25° C./50% RH) at a process speed of 300 mm/sec was changed in 5° C. steps beginning with 140° C. Using the toner to be evaluated, a solid image with a toner laid-on level of 0.40 mg/cm$^2$ was produced on the image-receiving paper, and a fixed image was formed on the image-receiving paper by an oil-less application of heat and pressure. The status of the traversing paper at this time was checked visually, and the temperature of the fixing unit when the feed paper did not undergo wraparound was investigated. The wraparound behavior during low-temperature fixation was evaluated based on the criteria given below. GF-600 (areal weight=60 g/m$^2$, marketed by Canon Marketing Japan Inc.) was used for the image-receiving paper.

A: less than 150° C.

B: 150° C. or above but less than 155° C.

C: 155° C. or above but less than 160° C.

D: 160° C. or above but less than 170° C.

E: 170° C. or above

A score of C or better was regarded as excellent in the present invention.

Evaluation of Transfer Drop-Out

Figure 3:
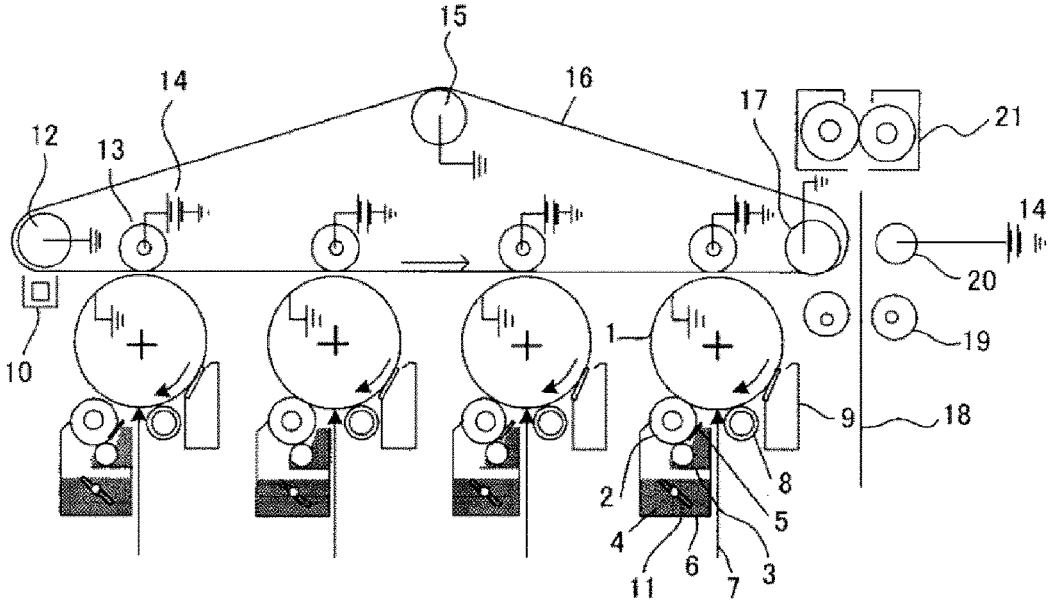
FIG. 3 is a schematic structural diagram that shows an example of an image-forming apparatus.

An LBP9600C laser beam printer from Canon Inc., which is a tandem machine having a structure as in FIG. 3, was modified to enable printing with just the cyan station. 200 g of the toner undergoing evaluation was filled into an LBP9600C toner cartridge, and each toner cartridge was held for 24 hours in a high-temperature, high-humidity environment (32.5° C./85% RH).

After holding for 24 hours, the toner cartridge was installed in the LBP9600C, and 15,000 prints of an image having a 1.0% print percentage were printed out in the A4 paper width direction. After the 15,000 prints had been output, a solid image with a toner laid-on level of 0.40 mg/cm$^2$ was output onto CS-680 (areal weight=68 g/m$^2$, marketed by Canon Marketing Japan Inc.). This image was visually inspected to carry out an evaluation of the transfer drop-out based on the scale given below. In the present invention, toner drop-out was assessed for regions displaying a loss of image uniformity.

The reference signs in FIG. 3 are as follows.

1: photosensitive member, 2: developing roller, 3: toner feed roller, 4: toner, 5: regulating blade, 6: developing apparatus, 7: laser light, 8: charging apparatus, 9: cleaning apparatus, 10: charging apparatus for cleaning, 11: stirring paddle, 12: driver roller, 13: transfer roller, 14: bias power source, 15: tension roller, 16: transfer transport belt, 17: driven roller, 18: paper, 19: paper feed roller, 20: attraction roller, 21: fixing apparatus A: transfer drop-out is not observed under normal light or under strong light B: transfer drop-out is not observed under normal light, but transfer drop-out is observed under strong light C: transfer drop-out is observed at one or two locations even under normal light, but blank dots are not observed D: transfer drop-out is seen at three or four locations even under normal light, but blank dots are not observed E: transfer drop-out is seen at five or more locations even under normal light, or a blank dot is seen at one or more locations A score of C or better was regarded as excellent in the present invention.

Evaluation of the Low-Temperature Fixability

Proceeding as in the evaluation of the wraparound behavior during low-temperature fixing, and using an LBP9600C modified to enable adjustment of the fixation temperature, the fixation temperature in a normal-temperature, normal-humidity environment (25° C./50% RH) at a process speed of 300 mm/sec was changed in 5° C. steps beginning with 140° C. Using the toner to be evaluated, a solid image with a toner laid-on level of 0.40 mg/cm$^2$ was produced on the image-receiving paper, and a fixed image was formed on the image-receiving paper by an oil-less application of heat and pressure. Using Kimwipes (S-200, Kuresia Co., Ltd.), the fixed image was rubbed 10 times under a load of 75 g/cm$^2$, and the temperature at which the percentage reduction in the image density pre-versus-post-rubbing became less than 5% was taken to be the fixation temperature, which was evaluated based on the criteria given below.

Business 4200 (areal weight=105 g/m$^2$, Xerox Corporation) was used for the image-receiving paper. An X-RITE 404A color reflection densitometer (X-Rite Inc.) was used to measure the image density; the relative density of the printed-out image to a white background area having an original density of 0.00 was measured; and the percentage reduction in the image density post-rubbing was calculated.

A: less than 150° C.

B: at least 150° C. but less than 160° C.

C: at least 160° C. but less than 170° C.

D: at least 170° C.

A score of C or better was regarded as excellent in the present invention.

Examples 1 to 19 and Comparative Examples 1 to 8

The wraparound behavior during low-temperature fixing, the transfer drop-out, and the low-temperature fixability were evaluated on each of the toners shown in Tables 1 and 2. The results are given in Table 3.

TABLE 1

| Toner No. | Type of organosilicon compound | Preparation conditions for organosilicon compound aqueous solution: pH | Temperature ° C. | Time min. | Number of parts of addition of organosilicon compound aqueous solution (parts) |
|---|---|---|---|---|---|
| 1 | Methyltriethoxysilane | 1.5 | 60 | 2 | 20.0 |
| 2 | Methyltriethoxysilane | 1.5 | 60 | 2 | 21.5 |
| 3 | Methyltriethoxysilane | 1.5 | 60 | 2 | 18.0 |
| 4 | Methyltriethoxysilane | 1.5 | 80 | 2 | 20.0 |
| 5 | Methyltriethoxysilane | 1.5 | 60 | 2 | 23.5 |
| 6 | Methyltriethoxysilane | 1.5 | 60 | 2 | 16.5 |
| 7 | Methyltriethoxysilane | 1.5 | 80 | 5 | 23.5 |
| 8 | Methyltriethoxysilane | 1.5 | 40 | 2 | 20.0 |
| 9 | Methyltriethoxysilane | 1.5 | 40 | 2 | 21.5 |
| 10 | Methyltriethoxysilane | 1.5 | 80 | 5 | 18.5 |
| 11 | Methyltriethoxysilane | 1.5 | 60 | 2 | 13.5 |
| 12 | Methyltriethoxysilane | 1.5 | 60 | 2 | 30.0 |
| 13 | Vinyltrimethoxysilane | 1.5 | 60 | 2 | 13.5 |
| 14 | N-propyltriethoxysilane | 1.5 | 60 | 2 | 13.5 |
| 15 | Allyltriethoxysilane | 1.5 | 60 | 2 | 13.5 |
| 16 | Hexyltriethoxysilane | 1.5 | 60 | 2 | 13.5 |
| 17 | Phenyltriethoxysilane | 1.5 | 60 | 2 | 13.5 |
| 18 | Methyltriethoxysilane | 1.5 | 80 | 2 | 30.0 |
| 19 | Methyltriethoxysilane | 1.5 | 80 | 5 | 30.0 |
| Comparative 1 | Methyltriethoxysilane | 1.5 | 60 | 2 | 1.5 |
| Comparative 2 | Methyltriethoxysilane | 1.5 | 60 | 2 | 67.5 |
| Comparative 3 | Methyltriethoxysilane | | | Described in text | |
| Comparative 4 | Methyltriethoxysilane | | | | |
| Comparative 5 | Methyltriethoxysilane | 1.5 | 60 | 2 | 37.0 |
| Comparative 6 | Hexyltriethoxysilane | 1.5 | 60 | 2 | 10.0 |
| Comparative 7 | Methyltriethoxysilane | | | Described in text | |
| Comparative 8 | Methyltriethoxysilane | | | | |
| Comparative 9 | Methyltriethoxysilane | | | | |

TABLE 2

| Toner No. | Luminance P1 | Luminance P2 | Percentage with respect to the total number of pixels (%) P1 | Percentage with respect to the total number of pixels (%) P2 | A1/AV | A2/AV | Pixel group A Area ($nm^2$) | Pixel group A Feret diameter (nm) | Presence/absence of network structure for the organosilicon polymer | Weight-average particle diameter (μm) |
|---|---|---|---|---|---|---|---|---|---|---|
| 1 | 38 | 165 | 1.08 | 0.91 | 2.25 | 3.01 | $5.43 \times 10^3$ | 95 | Present | 6.4 |
| 2 | 37 | 162 | 0.82 | 1.10 | 2.01 | 3.25 | $4.92 \times 10^3$ | 92 | Present | 6.5 |
| 3 | 39 | 166 | 1.09 | 0.88 | 2.47 | 2.88 | $6.41 \times 10^3$ | 102 | Present | 6.4 |
| 4 | 42 | 164 | 1.00 | 0.86 | 1.66 | 1.77 | $4.01 \times 10^3$ | 79 | Present | 6.4 |
| 5 | 35 | 159 | 0.67 | 1.10 | 1.75 | 3.44 | $3.88 \times 10^3$ | 71 | Present | 6.5 |
| 6 | 42 | 167 | 1.19 | 0.58 | 2.77 | 2.63 | $7.62 \times 10^3$ | 124 | Present | 6.5 |
| 7 | 44 | 166 | 0.97 | 0.84 | 1.56 | 1.68 | $3.40 \times 10^3$ | 66 | Present | 6.6 |
| 8 | 67 | 143 | 1.13 | 0.86 | 1.58 | 1.66 | $3.76 \times 10^3$ | 68 | Present | 6.4 |
| 9 | 62 | 137 | 1.01 | 0.97 | 1.53 | 1.67 | $2.89 \times 10^3$ | 64 | Present | 6.5 |
| 10 | 46 | 165 | 1.02 | 0.82 | 1.67 | 1.55 | $4.33 \times 10^3$ | 69 | Present | 6.5 |
| 11 | 40 | 166 | 1.28 | 0.52 | 3.00 | 2.36 | $9.14 \times 10^3$ | 146 | Present | 6.4 |
| 12 | 32 | 157 | 0.54 | 1.21 | 1.67 | 3.77 | $2.42 \times 10^3$ | 66 | Present | 6.4 |
| 13 | 41 | 162 | 1.31 | 0.53 | 3.04 | 2.42 | $1.05 \times 10^4$ | 145 | Present | 6.5 |
| 14 | 38 | 166 | 1.27 | 0.54 | 3.17 | 2.33 | $1.20 \times 10^4$ | 155 | Present | 6.6 |
| 15 | 40 | 166 | 1.29 | 0.53 | 3.11 | 2.44 | $1.25 \times 10^4$ | 157 | Present | 6.4 |
| 16 | 40 | 165 | 1.25 | 0.51 | 3.10 | 2.29 | $1.49 \times 10^4$ | 206 | Present | 6.4 |
| 17 | 41 | 167 | 1.17 | 0.57 | 2.84 | 2.65 | $7.88 \times 10^3$ | 137 | Present | 6.6 |
| 18 | 35 | 158 | 0.55 | 1.04 | 1.59 | 3.53 | $1.96 \times 10^3$ | 62 | Present | 6.6 |
| 19 | 38 | 157 | 0.54 | 0.98 | 1.52 | 3.21 | $1.77 \times 10^3$ | 56 | Present | 6.4 |
| Comparative 1 | 29 | — | 4.41 | — | — | — | — | — | Absent | 6.5 |
| Comparative 2 | — | 172 | — | 3.98 | — | — | — | — | Absent | 6.5 |
| Comparative 3 | 41 | 158 | 0.55 | 0.99 | 1.46 | 2.87 | $1.56 \times 10^3$ | 50 | Present | 6.6 |
| Comparative 4 | 48 | 164 | 1.03 | 0.80 | 1.55 | 1.45 | $3.42 \times 10^3$ | 64 | Present | 6.5 |
| Comparative 5 | 30 | 153 | 0.44 | 1.28 | 1.53 | 3.98 | $1.91 \times 10^3$ | 57 | Present | 6.4 |
| Comparative 6 | 38 | 162 | 1.37 | 0.45 | 3.32 | 2.03 | $1.64 \times 10^3$ | 212 | Present | 6.6 |
| Comparative 7 | 72 | 134 | 1.20 | 0.82 | 1.55 | 1.64 | $2.44 \times 10^3$ | 65 | Present | 6.4 |
| Comparative 8 | 67 | 128 | 1.04 | 0.97 | 1.52 | 1.68 | $2.11 \times 10^3$ | 62 | Present | 6.4 |
| Comparative 9 | 68 | 128 | 1.18 | 0.83 | 1.16 | 1.34 | $1.74 \times 10^3$ | 55 | Present | 6.5 |

TABLE 3

| Example No. | Toner No. | Wraparound behavior at low temperature | Transfer drop-out | Low-temperature fixability |
|---|---|---|---|---|
| 1 | 1 | A | A | A |
| 2 | 2 | A | A | A |
| 3 | 3 | A | A | A |
| 4 | 4 | B | A | A |
| 5 | 5 | B | A | A |
| 6 | 6 | A | B | A |
| 7 | 7 | B | B | A |
| 8 | 8 | C | B | A |
| 9 | 9 | C | C | A |
| 10 | 10 | B | B | A |
| 11 | 11 | A | B | A |
| 12 | 12 | C | A | A |
| 13 | 13 | A | B | B |
| 14 | 14 | A | B | B |
| 15 | 15 | A | B | B |
| 16 | 16 | A | B | C |
| 17 | 17 | A | B | A |
| 18 | 18 | C | A | B |
| 19 | 19 | C | A | C |
| Comparative 1 | Comparative 1 | A | E | C |
| Comparative 2 | Comparative 2 | E | A | C |
| Comparative 3 | Comparative 3 | D | A | C |
| Comparative 4 | Comparative 4 | B | D | A |
| Comparative 5 | Comparative 5 | D | A | C |
| Comparative 6 | Comparative 6 | A | D | C |
| Comparative 7 | Comparative 7 | D | C | A |
| Comparative 8 | Comparative 8 | C | D | A |
| Comparative 9 | Comparative 9 | D | E | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-96534, filed May 15, 2017, Japanese Patent Application No. 2017-96544, filed May 15, 2017, and Japanese Patent Application No. 2017-96504, filed May 15, 2017, which are hereby incorporated by reference herein in their entirety.

What is claimed is:

1. A toner comprising a toner particle containing a binder resin and a release agent, wherein the toner particle has a surface layer that contains an organosilicon polymer; and for a luminance histogram, obtained by acquiring a backscattered electron image of a 1.5 μm-by-1.5 μm square of the surface of the toner particle in scanning electron microscopic observation of the toner particle surface, and classifying a luminance of each pixel constituting this backscattered electron image into 256 levels from a luminance of 0 to a luminance of 255, and moreover placing the luminance on an abscissa and the number of pixels on an ordinate in this luminance histogram, (i) two peak values P1 and P2 and a minimum value V between P1 and P2 are present, and the peak containing P2 is a peak originating from the organosilicon polymer, (ii) the luminance giving P1 is from 20 to 70, (iii) the luminance giving P2 is from 130 to 230, (iv) a percentage for P1 and a percentage for P2 with respect to the total number of pixels in the backscattered electron image are each at least 0.50%, and (v) formulas (1) and (2) below are satisfied $$(A1/AV) \geq 1.50 \quad (1)$$

$$(A2/AV) \geq 1.50 \quad (2)$$

where Bl is the luminance giving V, A1 is the total number of pixels in a luminance range from 0 to (Bl−30), AV is the total number of pixels in a luminance range from (Bl−29) to (B1+29), and A2 is the total number of pixels in a luminance range from (Bl+30) to 255.

2. The toner according to claim 1, wherein the organosilicon polymer forms a network structure on the toner particle surface;

when the total pixels in the backscattered electron image are divided into a pixel group A for the luminance range from 0 to (Bl−30) and a pixel group B for the luminance range from (Bl−29) to 255, a network structure due to the pixel group B is observed, with the pixel group A being net openings; and for the domains formed by the pixel group A:

(i) a number-average value for an area is from $2.00\times10^3$ $nm^2$ to $1.00\times10^4$ $nm^2$, and (ii) a number-average value for a particle Feret diameter is from 60 nm to 200 nm.

3. The toner according to claim 1, wherein the organosilicon polymer is a polymer having a structure represented by formula (RaT3) below:

(RaT3)

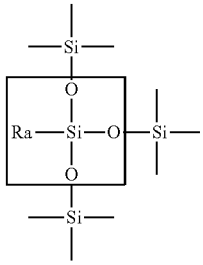

(i)

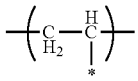

(ii)

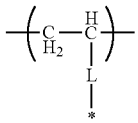

in the formula, Ra represents a hydrocarbon group having from 1 to 6 carbons or represents a vinyl polymer segment that contains a substructure represented by formula (i) or formula (ii), where * in formulas (i) and (ii) represents a binding segment with an element Si in the structure represented by formula (RaT3), and L in formula (ii) represents an alkylene group or an arylene group.

* * * * *